US005551320A

United States Patent [19]

Horobec et al.

[11] Patent Number: 5,551,320

[45] Date of Patent: Sep. 3, 1996

[54] SYSTEM FOR THE REMOVING OF THREADED FASTENERS

[76] Inventors: Bill R. Horobec; Judy K. Horobec, both of 9114 Canberly Dr., Tampa, Fla. 33647

[21] Appl. No.: 506,199

[22] Filed: Jul. 24, 1995

Related U.S. Application Data

[63] Continuation-in-part of Ser. No. 242,594, May 13, 1994.

[51] Int. Cl.[6] ..... B25B 13/50

[52] U.S. Cl. ..... 81/53.2; 81/120; 206/378

[58] Field of Search ..... 81/53.2, 120, 121.1, 81/124.3, 124.6; 206/378

[56] References Cited

U.S. PATENT DOCUMENTS

| | | | |
|---|---|---|---|
| 1,590,200 | 6/1926 | McGuckin | 81/121.1 X |
| 4,328,720 | 5/1982 | Shiel | 81/124.6 X |
| 4,671,141 | 6/1987 | Hanson | 81/53.2 |
| 4,993,289 | 2/1991 | Parks | 81/124.6 |

*Primary Examiner*—James G. Smith

[57] ABSTRACT

A device for the removing of threaded fasteners with rounded off heads from nuts combinations thereof comprising a socket head having a partly cylindrical external configuration with an upper end and a lower end and an axis with a first axial length therebetween and with a surface on the upper end adapted to receive the end of a turning tool externally and internally. The lower end of the socket head is fabricated with a major recess of a generally frustroconical configuration with a second axial length. The major recess has an interior surface formed with a plurality of V-shaped projections integral with the socket and extending radially inwardly from the lower end with V-shaped valleys intermediate the V-shaped projections, thereby forming a plurality of triangles with radially interior teeth. Each of the triangles has an apex with two faces of essentially common lengths. The faces of each triangle are offset essentially equally from the radius of the cylinder. The apex of each tooth is angularly oriented with respect to the axis of the cylinder. The axial interior of the major recess has a smaller diameter than the axial exterior of the major recess whereby when placed over the threaded fastener and when the socket head is rotated with a ratchet motion, the teeth will pull downwardly over the threaded fastener and bite into its exterior surface to effect a coupling therebetween for rotation of the socket head and associated threaded fastener to effect its removal.

4 Claims, 4 Drawing Sheets

FIG. 6
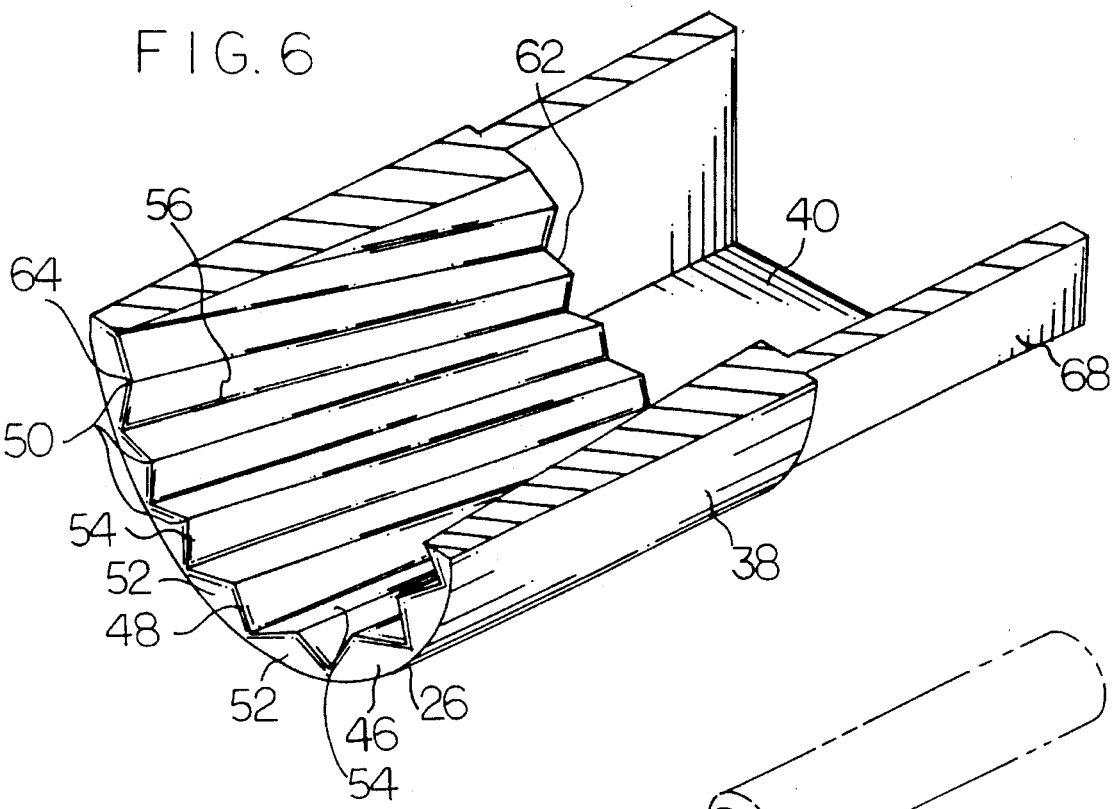
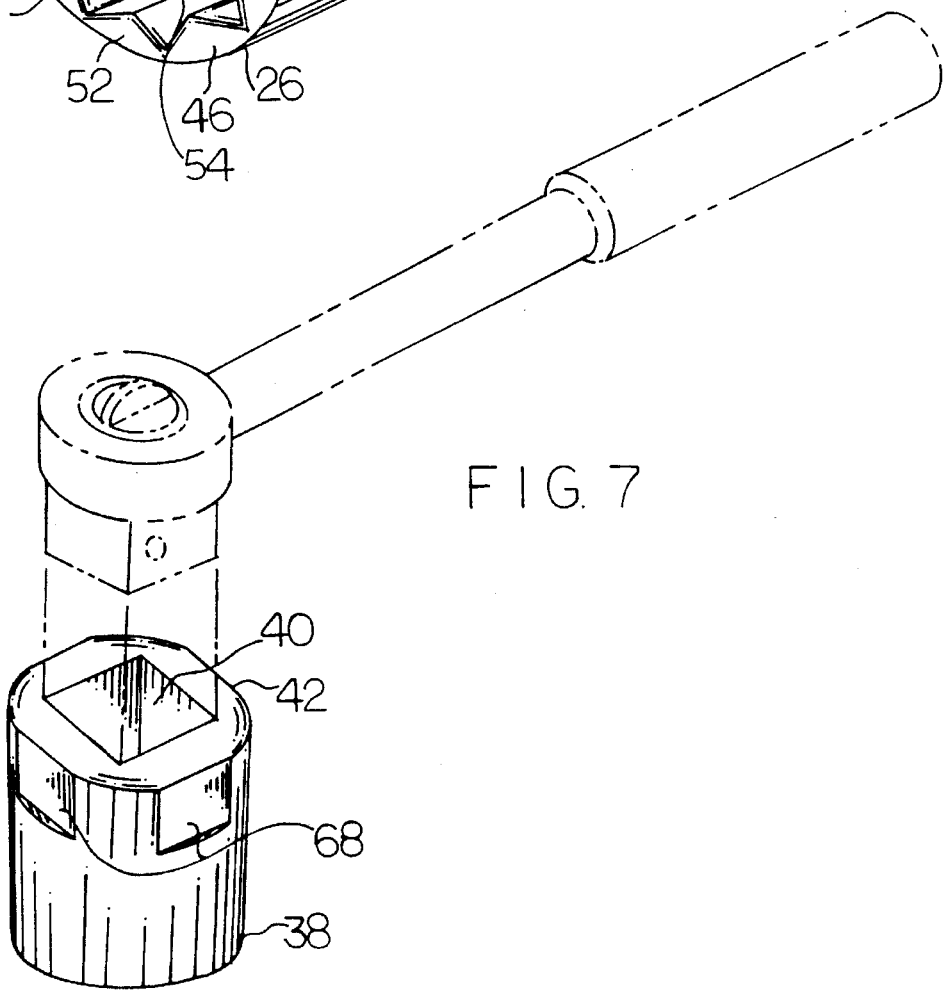
FIG. 7

SYSTEM FOR THE REMOVING OF THREADED FASTENERS

BACKGROUND OF THE INVENTION

1. Related Application

This application is a Continuation-In-Part Application of U.S. patent application Ser. No. 08/242,594, filed May 13, 1994.

2. Field of the Invention

The present invention relates to a system for the removing of threaded fasteners such as nuts, bolts and studs and more particularly pertains to removing threaded fasteners wherein the heads have been rounded off as through the use of sockets having teeth capable of biting into such heads.

3. Description of the Prior Art

The use of socket heads for removing threaded fasteners and techniques for facilitating such removal when the heads are rounded off as is known in the prior art. More specifically, socket heads for removing threaded fasteners and techniques for facilitating such removal when the heads are rounded off heretofore devised and utilized for the purpose of removing bolts when the heads thereof have become rounded off are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,123,310 to McManus a socket for turning fastener heads having deformed head surfaces.

U.S. Pat. No. 4,607,547 to Maartus discloses a stripped hex head drive socket.

U.S. Pat. No. 4,084,454 to Day discloses a socket head tool.

U.S. Pat. No. 4,063,472 to MacIntyre discloses a removable actuatable device for rotary knobs.

U.S. Pat. No. 3,847,042 to Wilson discloses a hand star wrench.

Lastly, U.S. Pat. No. 3,996,819 to King discloses a socket wrench attachment similar to applicant's invention but lacks the integral teeth, the teeth faces of essentially equal angle and size as well as the through hole for stud removal.

In this respect, the system for the removing of threaded fasteners such as nuts, bolts and studs according to the present invention substantially departs from the conventional concepts and designs of the prior art, and in so doing provides an apparatus primarily developed for the purpose of removing threaded fasteners wherein the heads have been rounded off as through the use of sockets having teeth capable of biting into such heads.

Therefore, it can be appreciated that there exists a continuing need for new and improved system for the removing of threaded fasteners such as nuts, bolts and studs which can be used for removing threaded fasteners wherein the heads have been rounded off as through the use of sockets having teeth capable of biting into such heads. In this regard, the present invention substantially fulfills this need.

SUMMARY OF THE INVENTION

In view of the foregoing disadvantages inherent in the known types of socket heads for removing threaded fasteners and techniques for facilitating such removal when the heads are rounded off now present in the prior art, the present invention provides an improved system for the removing of threaded fasteners, such as nuts, bolts and studs. As such, the general purpose of the present invention, which will be described subsequently in greater detail, is to provide a new and improved system for the removing of threaded fasteners, such as nuts, bolts and studs apparatus and method which has all the advantages of the prior art and none of the disadvantages.

To attain this, the present invention essentially comprises a new and improved device for the removing of threaded fasteners with rounded off heads from nuts comprising, in combination, a socket head having a partly cylindrical external configuration with an upper end and a lower end and an axis with a first axial length therebetween and with a square recess on the upper end adapted to receive the end of a ratchet wrench. On the partly cylindrical external upper side are flats to accommodate various sizes of open and box ended wrenchse. The lower end of the socket head is fabricated with a major recess of a generally frustroconical configuration with a second axial length constituting more than 50 percent of the first axial length. The major recess has an interior surface formed with a plurality of V-shaped projections integral with the socket and extending radially inwardly from the lower end with V-shaped valleys intermediate the V-shaped projections, thereby forming a plurality of triangles with radially interior teeth. Each of the triangles has an apex with two faces of essentially common lengths. The faces of each triangle is offset essentially equally from the radius of the cylinder. The apex of each tooth is angularly oriented with respect to the axis of the cylinder. The axial interior of the major recess has a smaller diameter than the axial exterior of the major recess. The major recess continues through the socket head beyond the projections with a width greater than the diameter of the major recess at its axial interior whereby when placed over a rounded off head of a threaded fastener, a portion thereof will extend beyond the projections. The socket head is rotated with a turning motion. The teeth will pull downwardly over the threaded fastener and bite into its exterior surface to effect a coupling therebetween for rotation of the socket head and associated threaded fastener to effect its removal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved system for the removing of threaded fasteners, such as nuts, bolts and studs which has all the advantages of the prior art socket heads for removing threaded fasteners and techniques for facilitating such removal when the heads are rounded off and none of the disadvantages.

It is another object of the present invention to provide a new and improved system for the removing of threaded fasteners such as nuts, bolts, studs and combinations thereof which may be easily and efficiently manufactured and marketed.

It is a further object of the present invention to provide a new and improved system for the removing of threaded fasteners such as nuts, bolts and studs which is of a durable and reliable construction.

An even further object of the present invention is to provide a new and improved system for the removing of threaded fasteners such as nuts, bolts, studs and combinations thereof which is susceptible of a low cost of manufacture with regard to both materials and labor, and which accordingly is then susceptible of low prices of sale to the consuming public, thereby making such socket heads for removing threaded fasteners and techniques for facilitating such removal when the heads are rounded off economically available to the buying public.

Still yet another object of the present invention is to provide a new and improved system for the removing of threaded fasteners such as nuts, bolts, studs and combinations thereof which provides in the apparatuses and methods of the prior art some of the advantages thereof, while simultaneously overcoming some of the disadvantages normally associated therewith.

Still another object of the present invention is to remove threaded fasteners wherein the heads have been rounded off as through the use of sockets having teeth capable of biting into such heads.

Lastly, it is an object of the present invention to provide a new and improved device for the removing of threaded fasteners with rounded off heads from nuts comprising a socket head. The socket head has a partly cylindrical external configuration with an upper end and a lower end and an axis with a first axial length therebetween and with a surface on the upper end adapted to receive the end of a turning tool either externally or internally. The lower end of the socket head is fabricated with a major recess of a generally frustroconical configuration with a second axial length. The major recess has an interior surface formed with a plurality of V-shaped projections integral with the socket and extending radially inwardly from the lower end with V-shaped valleys intermediate the V-shaped projections, thereby forming a plurality of triangles with radially interior teeth. Each of the triangles has an apex with two faces of essentially common lengths. The faces of each triangle are offset essentially equally from the radius of the cylinder. The apex of each tooth is angularly oriented with respect to the axis of the cylinder. The axial interior of the major recess has a smaller diameter than the axial exterior of the major recess whereby when placed over the threaded fastener and when the socket head is rotated with a ratchet or wrench motion, the teeth will pull downwardly over the threaded fastener and bite into its exterior surface to effect a coupling therebetween for rotation of the socket head and associated threaded fastener to effect its removal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a cross sectional view of the socket head taken vertically through the center of the socket head shown in Figure 5.

FIG. 7 is an exploded perspective view of the socket head for attachment with a ratchet handle.

Similar reference characters refer to similar parts throughout the several views of the drawings.

DESCRIPTION OF THE PREFERRED EMBODIMENT

Figure 1:
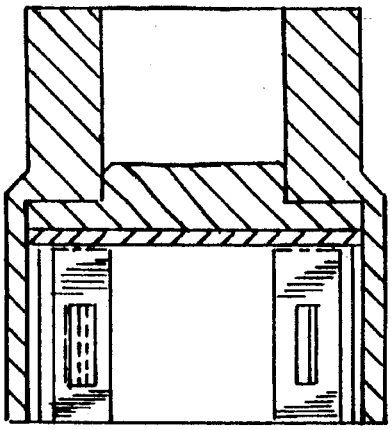
FIG 1 PRIOR ART
FIG. 1 is a sectional view of a socket head of a wrench.
Figure 2:
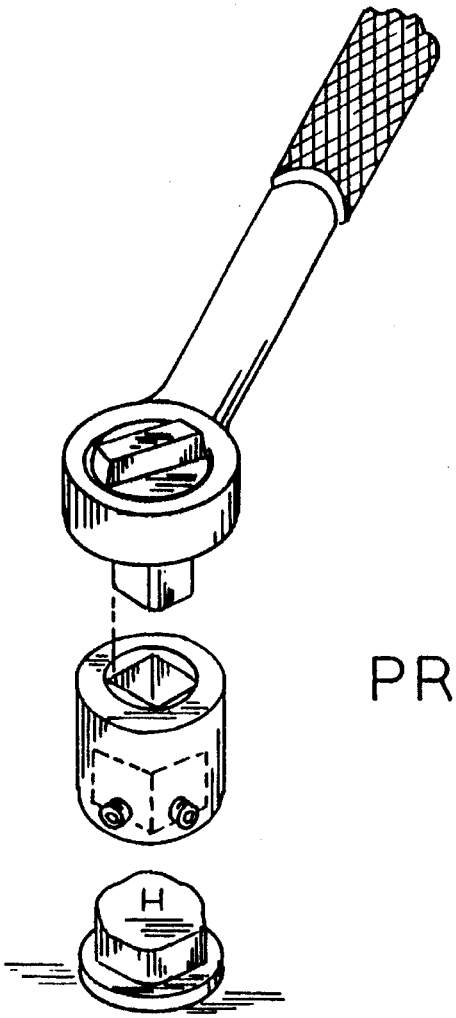
FIG 2 PRIOR ART
FIG. 2 is an exploded perspective view of a socket head wrench and associated bolt to be removed thereby
Figure 3:
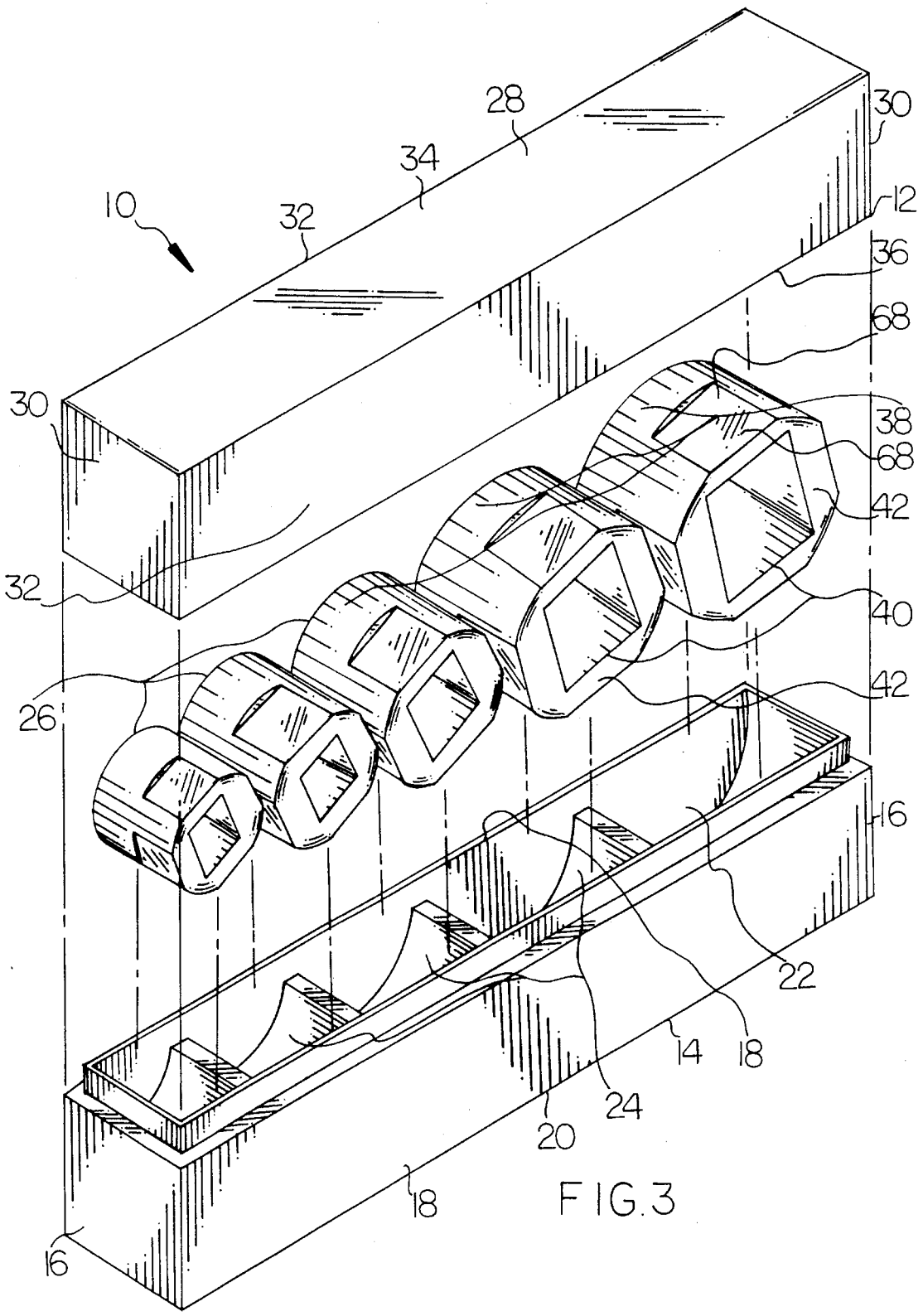
FIG. 3 is a perspective illustration of the preferred embodiment of the system for the removing of threaded fasteners, such as nuts, bolts and studs constructed in accordance with the principles of the present invention.
Figure 4:
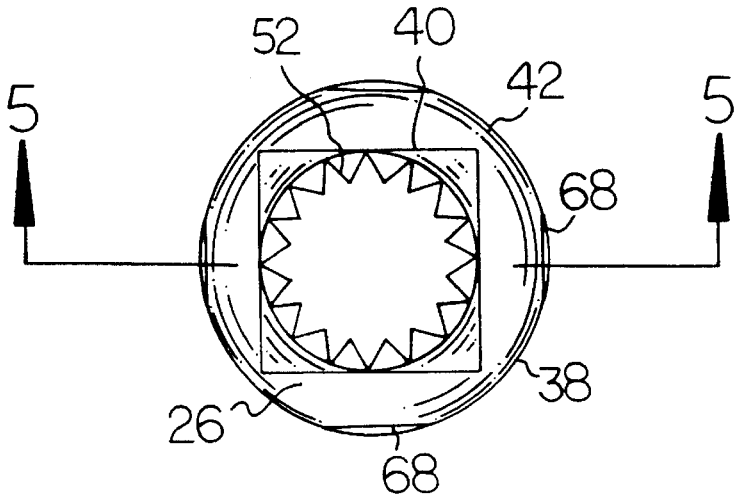
FIG. 4 is a top elevational view of one of the socket heads shown in FIG. 3.
Figure 5:
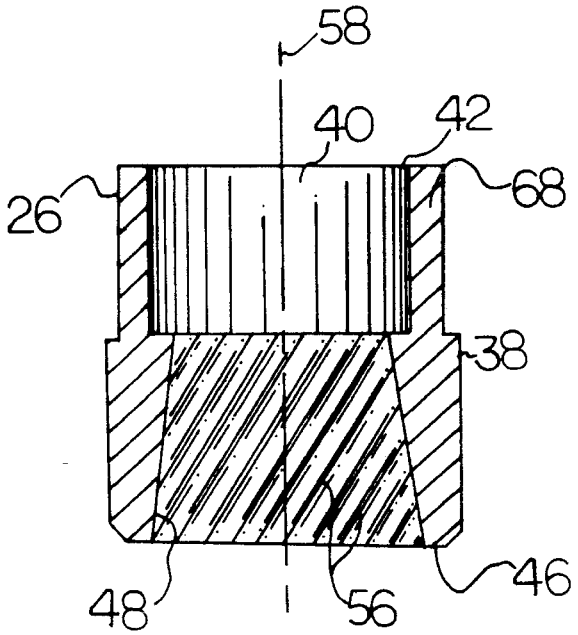
FIG. 5 is a cross sectional view of one of the socket heads taken along line 5—5 of FIG. 4.

With reference now to the drawings, and in particular to FIG. 1 thereof, a new and improved system for the removing of threaded fasteners such as nuts, bolts and studs embodying the principles and concepts of the present invention and generally designated by the reference numeral 10 will be described.

The present invention, the new and improved system for the removing of threaded fasteners such as nuts, bolts and studs, is comprised of a plurality of components. Such components in their broadest context include a container and a plurality of socket heads. Such components are individually configured and correlated with respect to each other so as to attain the desired objective.

More specifically, the present invention is a system 10 with a container 12. The container has a bottom portion 14 with parallel side walls 16 and parallel end walls 18 and a base 20 all coupled together at their edges. Within the bottom portion is a support surface 22. The support surface is formed with a plurality of semicircular sections 24. Such sections are of varying sizes adapted to receive socket heads 26 of varying sizes. The container is also provided with an upper portion or lid 28. The lid has side walls 30, end walls 32 and a top wall 34. It also has an open bottom 36 positionable over the bottom portion of the container. Next provided are a plurality of socket heads. Each socket head is of a different size for functioning with a different size bolt to be removed. Each socket head is formed partly cylindrical in its external configuration 38. Each also has a square recess 40 on its upper end 42. The upper end is adapted to receive the end of a rachet wrench in the conventional manner.

The lower end 46 of each socket head is fabricated with a recess 48. Such recess is of a generally frustroconical configuration. Such configuration includes a plurality of V-shaped projections 50 extending radially inwardly. Intermediate therebetween, the V-shaped recesses are a plurality of triangles 52 with radially interior teeth 54. The edge 56 of each tooth is angularly oriented with respect to the axis 58 of the cylinder. Such teeth are at an angle of between about 20 and 40 degrees from the axis. An angle of about 30 degrees is preferred.

The axial interior 62 of the recess has a smaller diameter than the axial exterior 64 of the recess. In this manner, when placed over a rounded off head of a bolt, stud or nut, nut stud or combinations thereof and rotated with a rachet motion, the teeth pull the invention downwardly over the head of the bolt and bite into its exterior surface. This will effect a coupling between the socket head and the bolt. Rotation of the partly cylindrical member of the socket head and coupled bolt will function to effect the removal of the bolt.

The present invention thus relates to apparatus for the removing of threaded fasteners such as studs or bolts with rounded off heads from nuts with rounded off surfaces from bolts. The apparatus comprises, in combination, a socket head having a cylindrical external configuration with an upper end and a lower end and an axis with a first axial length therebetween. The socket also has a square recess on the upper end adapted to receive the end of a ratchet wrench. It also preferably has flat regions 68 in its exterior surface, either 2, 4, 6, 8, etc, for receiving a wrench or other turning tool. The lower end of the socket head is fabricated with a major recess of a generally frustroconical configuration with a second axial length. Such second axial length preferably constitutes more than 50 percent of the first axial length.

The major recess has an interior surface formed with a plurality of V-shaped projections integral with the socket and extending radially inwardly from the lower end. Fabricating the teeth integral with the socket head decreases the cost of fabrication as compared with separable teeth as exemplified by king while increasing the efficiency during use. The formation of the V-shaped projections and teeth integral with the socket head is different from King and the rest of the prior art and reduces costs significantly with increasing efficiency in the use of the present invention. The projections include V-shaped valleys intermediate the V-shaped projections. The projections and valleys thereby form a plurality of triangles with radially interior teeth. Each of the triangles has an apex with two faces of essentially common lengths. The faces of each triangle are offset essentially equally from the radius of the cylinder. The apex of each tooth is angularly oriented with respect to the axis of the cylinder. This arrangement of teeth allows tightening and pulling down around the work-piece, the surface of a threaded fastener, when turned in one direction while allowing release when counter rotated. This is significantly different from the prior art as exemplified by King where the work-piece must be beaten out of the socket. The axial interior of the major recess has a smaller diameters than the axial exterior of the major recess. The square recess on the upper end which can accept the ratchet wrench has a width greater than the diameter of the major recess at its axial interior. In this manner, when the socket is placed over a rounded off head of a threaded fastener, a portion thereof may extend beyond the projections. The prior art as exemplified by King has no such enlarged hole greater than the smallest diameter of the lower portion of the socket, and, consequently, the prior art devices cannot remove nuts on elongated studs. Further, when the socket head is rotated with a ratchet or wrench motion as in the present invention, the teeth will pull downwardly over the threaded fastener and bite into its exterior surface to effect a coupling therebetween. This allows for rotation of the socket head and associated threaded fastener to effect its removal. The present invention is a tool for removing bolts, studs and nuts with rounded off heads. Frequently, when installing or trying to remove a bolt, stud or nut, nut stud or combination thereof a mechanic may chew up or round off its head, making it difficult to grab hold of the head with a conventional wrench or other tool. Studs become rusty and threads worn. The present invention pulls down to the base of the stud allowing for easy removal. Also, it may be difficult to get at in order to remove it. The present invention was conceived and a prototype was fabricated by the inventor to address this problem.

The present invention is a set of sockets that fit onto standard ratchets or wrenches. They are made of hardened tool steel and could be sold in two sets: set 1 with five pieces ranging in size from 8 to 15 millimeters and set 2 with four pieces ranging in size from 17 to 21 millimeters other sizes, including English units, are possible. The socket of the tool has very sharp grooves cut internally at a 60 degree angle from the horizontal, forming elongated sharp teeth that completely cover its inner surface.

To remove a bolt, stud or nut with a chewed up head, the mechanic attaches the proper size bolt remover to the ratchet or wrench, places the socket over the bolt, nut stud or combination thereof, stud or nut, and tightens the ratchet, thus drawing the sharp teeth tighter into the bolt, nut stud or combination thereof, stud or nut. The bolt remover pulls itself down on the damaged bolt, nut stud or combination thereof, stud or nut, enabling the tool to grab the head securely and remove the bolt, stud or nut. Also, the tool is able to reach hard to get at places by using different ratchet fittings and universal joints. For long studs the bolt remover would pull the stud and nut until it reaches the base of the stud then it will bind and remove the stud nut.

The present invention makes it much easier to remove bolts with rounded off heads. It could be a very practical and time saving tool for professional and amateur mechanics.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved device for the removing of threaded fasteners with rounded off heads from nuts comprising, in combination:

a socket head having a partly cylindrical external configuration with an upper end and a lower end and an axis with a first axial length therebetween and with a square recess on the upper end that may receive the end of a ratchet wrench, the lower end of the socket head being fabricated with a major recess of a generally frustroconical configuration with a second axial length constituting more than 50 percent of the first axial length, the major recess having an interior surface formed with a plurality of V-shaped projections integral with the socket and extending radially inwardly from the lower end with V-shaped valleys intermediate the V-shaped projections, thereby forming a plurality of triangles with radially interior teeth, each of the triangles having an apex with two faces of essentially common lengths, the faces of each triangle being offset essentially equally from the radius of the cylinder, the apex of each tooth being angularly oriented with respect to the axis of the cylinder, the axial interior of the major recess, having a smaller diameter than the axial exterior of the square recess, the major recess having a width greater than the diameter of the major recess at its axial interior whereby when placed over a rounded off head of a threaded fastener, a portion thereof will extend beyond the projections, and the socket head is rotated with a ratchet motion, the teeth will pull downwardly over the threaded fastener and bite into its exterior surface to effect a coupling therebetween for rotation of the socket head and associated threaded fastener to effect its removal.

2. A device according to claim 1 wherein the upper end has a series of flats adapted to receive a wrench of the open or box end type.

3. A new and improved set of devices for the removing of threaded fasteners with rounded off heads from nuts comprising, in combination:

a set of socket heads of varying sizes each head having a partially cylindrical external configuration with an upper end and a lower end and an axis with a first axial length therebetween and with a square recess on the upper end that may receive the end of a ratchet wrench, the lower end of each socket head being fabricated with a major recess of a generally frustroconical configuration with a second axial length constituting more than 50 percent of the first axial length, the major recess having an interior surface formed with a plurality of V-shaped projections integral with the socket and extending radially inwardly from the lower end with V-shaped valleys intermediate the V-shaped projections, thereby forming a plurality of triangles with radially interior teeth, each of the triangles having an apex with two faces of essentially common lengths, the faces of each triangle being offset essentially equally from the radius of the cylinder, the apex of each tooth being angularly oriented with respect to the axis of the cylinder, the axial interior of the major recess having a smaller diameter than the axial exterior of the major recess, the square recess having a width greater than the diameter of the major recess at its axial interior whereby when placed over a rounded off head of a threaded fastener, a portion thereof will extend beyond the projections, and the socket head is rotated with a ratchet motion, the teeth will pull downwardly over the threaded fastener and bite into its exterior surface to effect a coupling therebetween for rotation of the socket head and associated threaded fastener to effect its removal.

4. A device according to claim 3 wherein the upper end of each socket has a series of flats adapted to receive a wrench of the open or box end type.

* * * * *